United States Patent [19]

MacDermott et al.

[11] Patent Number: 4,501,163

[45] Date of Patent: Feb. 26, 1985

[54] ADJUSTABLE MICRO-DISPENSING LIQUID PIPET

[76] Inventors: Bruce R. MacDermott, 2835 Prince St., Berkeley, Calif. 94705; Justin J. Shapiro, 620 Hearst Ave., Berkeley, Calif. 94710

[21] Appl. No.: 527,783

[22] Filed: Aug. 30, 1983

[51] Int. Cl.[3] ..... B01L 3/02

[52] U.S. Cl. ..... 73/864.13; 73/864.18

[58] Field of Search ..... 73/864.11, 864.12, 864.13, 73/864.14, 864.15, 864.16, 864.17, 864.18; 422/100

[56] References Cited

U.S. PATENT DOCUMENTS

| | | | |
|---|---|---|---|
| 3,013,435 | 12/1961 | Rodrigues, Jr. | 73/864.18 |
| 4,023,716 | 5/1977 | Shapiro | 73/864.13 |
| 4,362,063 | 12/1982 | d'Autry | 73/864.13 |

*Primary Examiner*—S. Clement Swisher
*Attorney, Agent, or Firm*—Herman L. Gordon

[57] ABSTRACT

A liquid micro-dispensing pipet consisting of a main barrel with a snap-on dispensing tube tip. An axial, upwardly spring-biased operating shaft is slidably and rotatably engaged in the barrel, connected to a plunger in the dispensing tip. The snap-on tip can be at times disengaged from the barrel by exerting axial downward force on the shaft. Stop means to limit the intake movement of the plunger is provided, said stop means consisting of an abutment sleeve slidably and non-rotatably mounted on the upper portion of the shaft and threadedly engaged in the barrel, the abutment sleeve being engageable from below by a stop washer secured on the shaft, which is normally urged upwardly by its biasing spring. The normal elevated position of the plunger can be varied by rotating the barrel relative to the shaft. The shaft has a hexagonal upper portion which slidably and non-rotatably engages in the abutment sleeve, and which also drivingly engages through the drive wheel of a 3-wheel digital counter of the internal pinion type, mounted in the top portion of a handle secured to the barrel, a viewing window for observing the number wheels being provided in the handle. Secured on the top end of the operating shaft is a knurled hollow bushing for manually rotating the shaft relative to the barrel. A calibrating tool rod is carried by a push-button disc. The rod is housed in the hollow bushing and in a recess in the top of the shaft and depends axially from the disc via a hub rotatably carrying a split friction ring engaging the inside wall of the bushing and retentively holding the push-button disc in overlying relation to the bushing while allowing it to rotate freely relative to the bushing.

8 Claims, 7 Drawing Figures

ADJUSTABLE MICRO-DISPENSING LIQUID PIPET

FIELD OF THE INVENTION

This invention relates to syringe-type pipets, and more particularly to a micro-dispensing, positive-displacement pipet of the type employing a snap-on precision dispensing tube tip and having a dispensing plunger whose retracted intake position may be adjusted to provide an accurately preset delivery volume.

BACKGROUND OF THE INVENTION

Typical examples of previously known micro-dispensing pipets of the type employing snap-on precision dispensing tubes are illustrated respectively in U.S. Pat. Nos. 4,023,716 and 4,165,646 to J. J. Shapiro. These dispensing pipets employ plunger elements which are adjustable in the dispensing tubes to provide a definite preset delivery volume. Calibration rods are employed to set the plunger elements in a position spaced from the open end of the tip in accordance with the length of a selected calibration rod, which corresponds to a desired delivery volume. In U.S. Pat. No. 4,023,716, the dispensing tube may be transparent and marked with scale lines to indicate volumetric settings. In U.S. Pat. No. 4,165,646, a helical volume scale is provided on the pipet barrel, readable through a notch or window in a guard sleeve relative to which the barrel is adjustable. In each case, the numerical volumetric data obtainable is relatively imprecise and is somewhat difficult to observe. Hence, there is a definite need to improve the precision and accessibility of the observed numerical volumetric data.

In U.S. Pat. No. 4,362,063 to M. d'Autry there is shown a dispensing pipet wherein a plurality of volume-indicator drums are employed in a decade configuration drivingly controlled by a prismatic control rod which is used to set the position of a stop bushing limiting the travel of the pipet dispensing piston. The decade action is provided by the use of external pinion sprocket elements which make the decade drum assembly quite bulky. There is a definite need to reduce the bulk of the apparatus by reducing the bulk of the decade drum configuration, as well as to simplify the mechanical assembly associated with the adjustable stop bushing.

SUMMARY OF THE INVENTION

Accordingly, a main object of the invention is to provide an improved liquid dispensing pipet which overcomes the deficiencies and disadvantages of the previously known syringe-type pipet devices.

A further object of the invention is to provide an improved dispensing pipet whose delivery volume can be easily preset and which is clearly indicated numerically on counter-type display wheels through an aperture in the handle of the pipet.

A still further object of the invention is to provide an improved micro-dispensing liquid pipet which is simple in construction, which is compact in size, which is easy to operate, which can be easily adjusted as to dispensing volume, and which indicates the adjusted volume in large and distinct numbers.

A still further object of the invention is to provide an improved micro-dispensing liquid pipet of the type employing an adjustable threaded volume-determining stop bushing for establishing a preset dispensing volume, having means for preventing accidental rotation of its adjusting shaft by allowing the push button of the operating shaft to rotate freely without turning the shaft, and being provided with means to lock the shaft against undesired rotation.

A still further object of the invention is to provide an improved micro-dispensing liquid pipet of the type employing a snap-on dispensing tip and having improved guard means for maintaining integrity of its stop bushing adjustment, as well as for protecting the numbers on its indication dials from obliteration or erasure by rubbing contact with the user's fingers.

A still further object of the invention is to provide an improved micro-dispensing liquid pipet of the type employing changeable snap-on dispensing tips, the pipet being accurately adjustable in delivery volume in accordance with the dispensing volume of the particular snap-on tip employed.

A still further object of the invention is to provide an improved micro-dispensing liquid pipet employing a digital counter mechanism with a dispensing shaft extending through and being slidably but drivingly engaged with the counter mechanism, the shaft being operatively coupled to a threadedly adjustable dispensing stop member in a manner to show digitally the adjusted position of the stop member in volumetric units corresponding to the adjusted volumetric dispensing capacity of the liquid pipet.

BRIEF DESCRIPTION OF THE DRAWINGS

Further objects and advantages of the invention will become apparent from the following description and claims, and from the accompanying drawings, wherein:

DETAILED DESCRIPTION OF A PREFERRED EMBODIMENT

Figure 1:
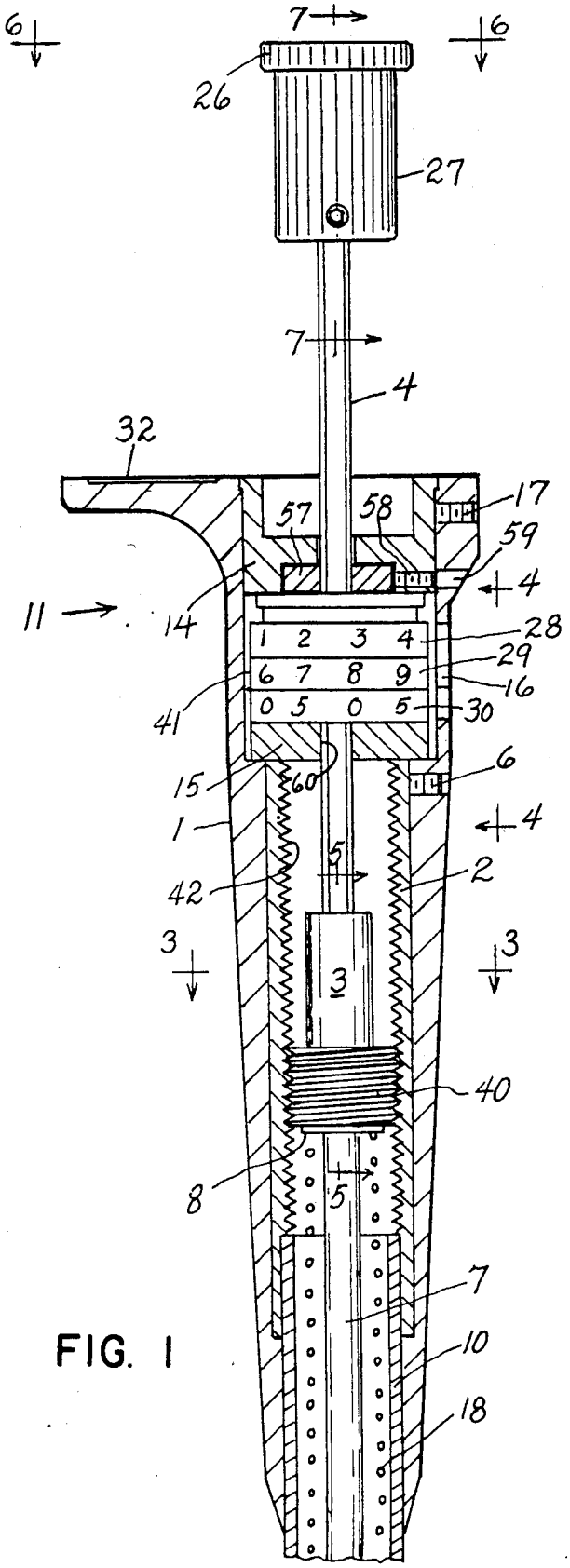
FIG. 1 is an enlarged vertical cross-sectional view of the upper portion of an improved liquid micro-dispenser device constructed in accordance with the present invention.

Referring to the drawings, 11 generally designates a typical embodiment of a liquid micro-dispenser device according to the present invention. The device 11 is generally of the type shown in U.S. Pat. No. 4,023,716, to Justin J. Shapiro, and comprises a hollow handle 1 within which a main barrel 2 is adjustably secured. Within the upper portion of the main barrel 2 an adjustable stop sleeve 3 is threadedly engaged. The stop member 3 is slidably engaged on a hexagonal operating shaft 4 but has a hexagonal bore 5 (FIG. 5) which interfits with and is thereby locked rotationally to shaft 4. A set screw 6 secures the main barrel 2 to handle 1.

Figure 5:
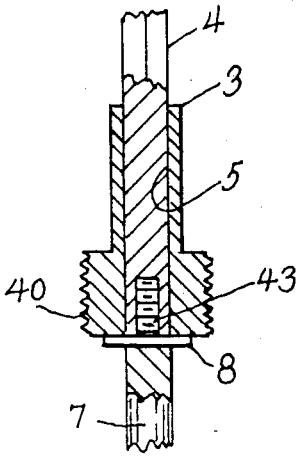
FIG. 5 is a fragmentary vertical cross-sectional view taken substantially on line 5—5 of FIG. 1.

A round operating shaft extension 7 is threadedly secured axially to the hexagonal operating shaft 4. As shown in FIG. 5, a stop washer 8 is locked on the reduced stud portion 43 of member 7 between the coaxial shaft members 4 and 7. Washer 8 normally abuts the enlarged externally threaded lower portion 40 of stop member 3.

A main barrel extension 10 is rigidly secured to the main barrel 2. A flanged abutment bushing 9 is secured on the lower end of the main barrel extension 10. Bushing 9 slidably receives the operating shaft extension 7. A somewhat resilient snap-on dispensing pipet 21 with an inwardly-directed integral locking rib element, as described in U.S. Pat. No. 4,023,716, is detachably lockingly engaged on the annularly-grooved, reduced bottom end portion of bushing 9.

Designated at 41 is a conventional 3-decade counter assembly of the internal-pinion type, with a mounting bushing 14, numbered display wheels 28, 29, 30, and a driving wheel 15, said counter assembly being secured to handle 1 by a set screw 17 which clampingly engages bushing 14. Drive wheel 15 has a hexagonal central aperture which conformably and non-rotatively receives the hexagonal operating rod 4. Shaft 4 passes unobstructedly through circular central apertures provided in mounting bushing 14 and number wheels 28, 29 and 30. The "units" wheel 30 is rigidly coaxially secured to drive wheel 15, whose hexagonal central aperture is shown at 60.

Figure 4:
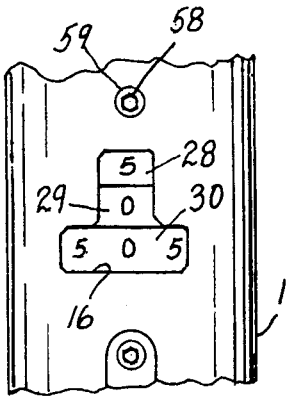
FIG. 4 is a fragmentary vertical elevational view take substantially on the line 4—4 of FIG. 1.
Figure 3:
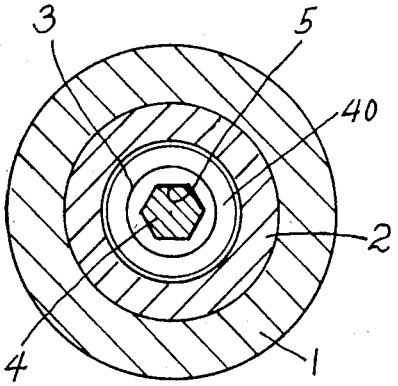
FIG. 3 is an enlarged horizontal cross-sectional view taken substantially on the line 3—3 of FIG. 1.

Barrel 2 has internal threads 42 which are threadedly engaged by lower portion 40 of stop member 3, the thread pitch and the counter display numbers being chosen to indicate volumes in microliter units directly via a viewing window 16 (FIG. 4) provided in the adjacent wall of handle 1.

Surrounding shaft 7 inside barrel extension 10 is a coiled spring 18, bearing between the top end rim of abutment bushing 9 and stop washer 8. Spring 18 biases the operating shaft 7 upwardly so as to return the pipet plunger, shown at 20, to a normal elevated position in the precision bore of pipet 21.

The drive wheel 30 transmits a numerical increment to "tens" character wheel 29 via a first internal pinion gear responsive to one rotation of the drive wheel 30. In a similar manner, a complete rotation of the "tens" character wheel 29 transmits a "hundreds" numerical increment to the "hundreds" character wheel 28 via a second internal pinion gear. Each pinion gear has two sets of gear teeth, one set being driven by the lower order character wheel and the other set drivingly engaging the higher order character wheel at the completion of a rotation of the lower order character wheel. When rotation of the shaft 4 is reversed, the mechanism is driven in the reverse direction, which returns the character wheels to their original positions. The character wheels 28, 29, 30 are formed with internal teeth engageable by the pinion gears.

The decade counter 41 may be generally similar to digital counters of the internal pinion type shown, for example, in the U.S. Pat. to G. L. Manke, No. 2,753,116, J. H. Morehead, No. 2,967,356, F. E. Miner, No. 3,107,855 and H. H. Harada, No. 3,137,444.

Figure 7:
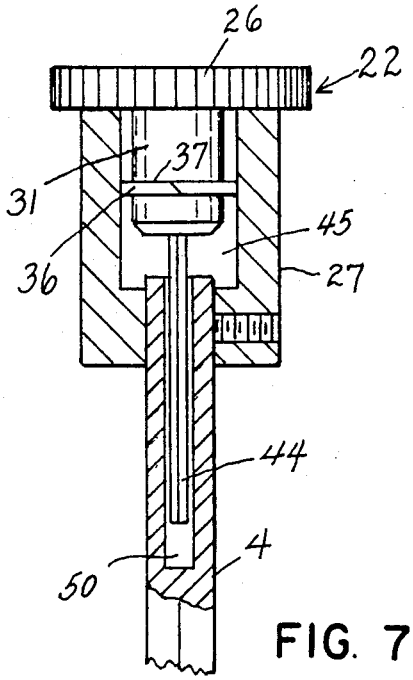
FIG. 7 is an enlarged vertical cross-sectional view taken substantially on the line 7—7 of FIG. 1.

Secured on the top end portion of hexagonal shaft 4 is a cup-like bushing 27 with a serrated outer surface, employed for manually rotating shaft 7 to adjust the position of stop member 3 in main barrel 2. A calibration rod and tool 22 (FIG. 7) is provided, said tool having a hexagonal shank 44 extending from a hub member 31 depending from a disc element 26. The shank 44 is rotatably receivable in a recess 50 provided therefor in the top portion of shaft 4, and hub 31 is likewise receivable in a cavity 45 provided therefor in bushing 27. The hub 31 has a peripheral groove 37 which loosely holds a split wire ring fastener 36 which is resiliently and lockingly receivable in cavity 45. The hub 31 and its push button disc 26 are free to rotate when the assembly 22 is lockingly engageable in the cylindrical counterbore 45 of the bushing 27. Thus, no torque is applied to the bushing 27 when the push button disc 26 is pressed and released during the operation of the device, yet the calibration-tool assembly 22 is normally retained in the bushing 27 by the frictional force exerted by the split spring wire ring fastener 36. Thus, the assembly 22 is normally removably and rotatably retained in the bushing 27, as shown in FIG. 7. Since assembly 22 is freely rotatable, it cannot accidentally impart a rotational movement to shaft 4 which would change the volume delivered by the micropipet.

Slidably and non-rotatably mounted on shaft 4 and retained in a recess in bushing 14 is a locking bushing 57. A set screw 58 which may be accessed through an opening 59, may, like set screw 17, be tightened by the calibration tool 44 to prevent rotation of shaft 4, thus locking the volume adjustment and the counter display. In adjusting the device, the set screw 58 is loosened.

As in U.S. Pat. No. 4,023,716, the downward travel of shaft 7 is limited by the engagement of its bottom end portion (a thumb nut 34) with the shoulder means defined by the conical portion 35 of pipet 21, and the pipet member 21 may be disengaged from its snap-fit engagement on bushing bottom end portion 25 by exerting downward force on push button 26, as described in said U.S. Pat. No. 4,023,716.

In normal operation, plunger 20 is depressed to the bottom of pipet member 21 by manually depressing push button 26 relative to the handle 1, inserting the pipet member 21 into the liquid supply receptacle to allow the pipet member 21 to be filled by suction, conveying the pipet to the receiving receptacle, and then discharging the metered quantity of liquid by depressing plunger 20 to the bottom plane of orifice 56 of the pipet member 21. The plunger 20 is supported by a serrated wire 33, threadedly and adjustably secured axially to shaft member 7, and locked in adjusted position by the knurled locknut 34. The extent that plunger 20 can be moved beyond orifice 56 upon delivery of liquid is thus adjustable and locked by means of the thumb nut 34. Thus, the delivered volume may be corrected when accessories such as manifolds or valves are attached to the pipet. With these accessories, the bottom tip of plunger 20 must not extend beyond orifice 56. The limit of upward travel of the plunger 20 may be adjusted from a position of zero delivery (where plunger 20 is normally held at the tip orifice 56) to a position of maximum delivery at the upper end of the precision bore of pipet tube 21. As the bushing 3 is advanced by rotating shaft 4 relative to the main barrel 2, the numbers on the counter wheels 28, 29, 30, indicating the intake volume, appear in window 16 in handle 1.

Figure 2:
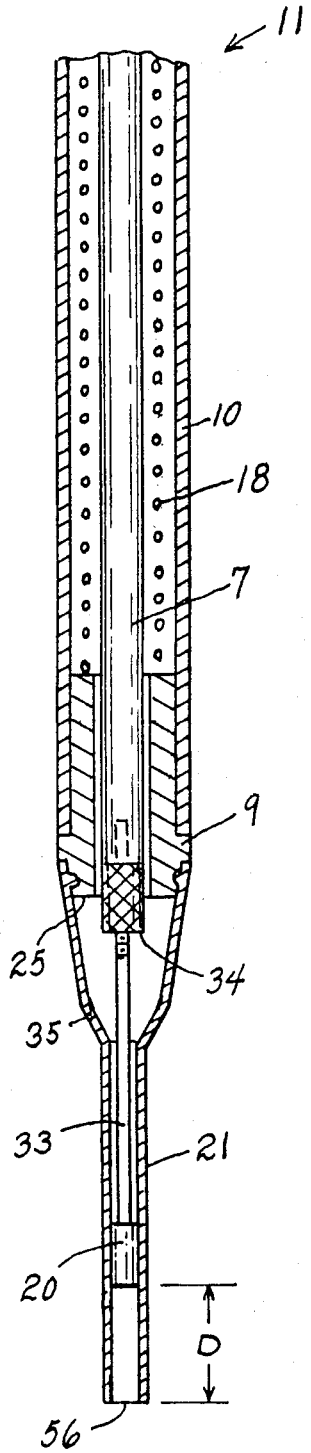
FIG. 2 is a similarly enlarged vertical cross-sectional view of the lower portion of the device of FIG. 1.
Figure 6:
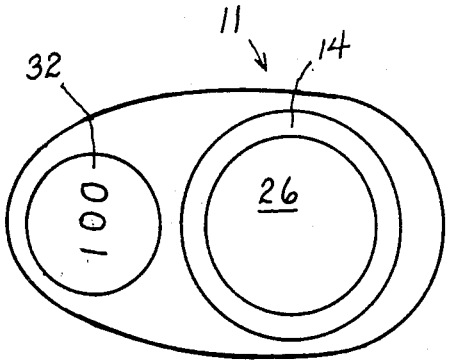
FIG. 6 is a top plan view taken substantially on the line 6—6 of FIG. 1.

Calibration of the instrument is accomplished by rotating the main barrel extension 10 (relative to shaft member 4) while the display wheels 28, 29, 30 remain fixed at the maximum precision volume. Rotating the barrel member 10 causes relative displacement of the plunger 20 up or down through the calibration distance D. To calibrate, the adjustment tool 22 is detached from bushing 27 by pulling the disc 26 upwardly from said bushing. The length of the hexagonal rod 44, up to the hub 31, is equal to the calibration distance D (FIG. 2) from pipet orifice 56 to plunger 20 for delivery of the maximum precision volume of pipet member 21. This volume appears on the label 32 (FIG. 6). The rod element 44 is inserted for its full length through the orifice 56 and the counter wheels are turned by rotating bushing 27 until the desired maximum precision volume is displayed in window 16. With set screw 6 loosened by the calibration tool 22, the main barrel is rotated until the plunger 20 is at the calibration distance D, exactly equal to the length of rod 44. The set screw 6 is then tightened by means of the hexagonal tool rod 44.

When the precision bore of pipet member 21 is smaller than the diameter of rod element 44, a wire of suitable diameter and of calibrated length may be used instead of tool 22.

Various modifications within the spirit of the present invention may occur to those skilled in the art. It is intended that such modifications should be comprehended within the meaning and range of equivalents of the disclosed embodiment.

What is claimed is:

1. A pipet comprising a main barrel provided with an axial operating shaft slidably and rotatably supported in the barrel, said barrel having an internally threaded portion, a dispensing tip yieldably connected to said main barrel, said dispensing tip comprising a yieldable barrel-coupling portion and a conduit portion, a plunger operatively engaged in said conduit portion, means coaxially connecting said plunger to said shaft, whereby the plunger can be reciprocated by reciprocating said shaft, and means to disengage said barrel-coupling portion from said barrel at times responsive to axial force exerted on said shaft, wherein said tip includes annular internal shoulder means, wherein said disengaging means comprises abutment means moving with said shaft and being engageable with said shoulder means to transmit said axial force, and wherein said abutment means is engageable with said shoulder means to normally limit the discharge movement of said plunger in said conduit portion, and cooperating stop means to limit intake movement of said plunger in said conduit portion, said stop means comprising an abutment stop element secured on said shaft, an externally threaded abutment stop sleeve member slidably and non-rotatably engaged on said shaft and being threadedly engaged with said internally threaded portion inside said barrel above said abutment stop element, and spring means biasing said abutment stop element upwardly into engagement with said stop sleeve member to establish the normal elevated position of the plunger in said conduit portion, whereby said normal elevated position can be varied by rotating the shaft relative to said main barrel, and wherein said shaft has a non-circular cross-sectional upper portion and said stop sleeve member has an axial non-circular bore slidably and nonrotatably fitting on said non-circular shaft portion, the top end of said shaft portion having a hollow bushing member axially secured thereon for at times manually rotating said shaft, a top push-button disc member overlying the top end of said hollow bushing member, and means rotatably and detachably securing said disc member on said bushing member.

2. The pipet of claim 1, and wherein said abutment stop element comprises a washer secured on and projecting outwardly from said shaft.

3. The pipet of claim 1, and digital indicating counter means mounted at the top end of the barrel and being operatively engaged by said non-circular shaft portion.

4. The pipet of claim 1, and digital-indicating counter means of the multiple digit wheel, internal pinion type mounted at the top end of the barrel, said counter means being provided with a driving wheel having a non-circular central aperture conformably and slidably receiving said non-circular shaft portion.

5. The pipet of claim 4, and wherein said pipet is provided with a top handle member secured coaxially on the top portion of said main barrel, said counter means being mounted in said handle member and said handle member being provided with a viewing window exposing the digit wheels of the counter means.

6. The pipet of claim 1, and wherein said means rotatably and detachably securing said push-button disc member on said bushing member comprises a depending central hub element on said disc member, and a resilient friction ring rotatably mounted on said hub element and expansively engaging the inside wall surface of the hollow bushing member.

7. The pipet of claim 6, and wherein said hub element is formed with a peripheral groove receiving said friction ring.

8. The pipet of claim 6, and wherein said disc member is provided with an axial depending calibration rod and the top end of said shaft is recessed to rotatably receive said calibration rod.

* * * * *